US012522397B2

(12) United States Patent
Whatling et al.

(10) Patent No.: US 12,522,397 B2
(45) Date of Patent: Jan. 13, 2026

(54) CONTAINER

(71) Applicant: Multi Packaging Solutions UK Limited, Nottinghamshire (GB)

(72) Inventors: Tom J. Whatling, Harleston (GB); Scott Alexander, Richmond (GB); Richard P. Throup, Nottinghamshire (GB); Raymond De Rouwe, Nottinghamshire (GB)

(73) Assignee: Multi Packaging Solutions UK Limited

( * ) Notice: Subject to any disclaimer, the term of this patent is extended or adjusted under 35 U.S.C. 154(b) by 69 days.

(21) Appl. No.: 18/418,017

(22) Filed: Jan. 19, 2024

(65) Prior Publication Data

US 2024/0246716 A1 Jul. 25, 2024

(51) Int. Cl.
*B65D 5/20* (2006.01)
*B65D 5/42* (2006.01)

(52) U.S. Cl.
CPC ..... *B65D 5/2076* (2013.01); *B65D 5/4266* (2013.01)

(58) Field of Classification Search
CPC .. B65D 5/2076; B65D 5/4266; B65D 5/0236; B65D 5/56; B65D 5/0281; B65D 5/0272; B65D 5/0227; B65D 5/16; B65D 5/62; B65D 5/10; B65D 2571/00666; B65D 5/029; B65D 5/0245; B65D 5/2095; B65D 71/38
USPC ..... 229/100, 87.19, 923, 164.1, 132, 140; 206/457
See application file for complete search history.

(56) References Cited

U.S. PATENT DOCUMENTS

| | | | |
|---|---|---|---|
| 2,273,470 | A | 2/1942 | Gardner |
| 2,950,036 | A | 8/1960 | Vergobbi |
| 3,182,883 | A | 5/1965 | Doble, Jr. |
| 5,265,799 | A | 11/1993 | Stone |

FOREIGN PATENT DOCUMENTS

| | | | |
|---|---|---|---|
| CA | 943513 | A | 3/1974 |
| EP | 1955958 | A1 | 8/2008 |

OTHER PUBLICATIONS

EP 24152589.8 Search Report dated May 23, 2024, 7 pages.

*Primary Examiner* — Christopher R Demeree
(74) *Attorney, Agent, or Firm* — Brian J. Goldberg; Rohini K. Garg

(57) ABSTRACT

There is provided herein a container with four side wall panels 10, 12, 14, 16, four base panels 36, 38, 40, 42 connected thereto about fold lines and a glue panel 18. The container has an overwrap layer 8 covering the panels 10, 12, 14, 16, 18, 36, 38, 40, 42. The overwrap layer 8 has overhanging portions 70, 72 which overhang the edges of a pair of the base panel portions 38, 42 and are adhered to the other base panel portions 36, 40. There is also provided a method for making such a container and a blank 26 for such a container.

15 Claims, 11 Drawing Sheets

CONTAINER

TECHNICAL FIELD

The present invention relates to containers made of card-based or paper-based materials such as cardboard or paperboard, or made of other flexible sheet materials and methods and blanks for manufacturing such containers. The present invention is particularly concerned with containers in the form of a box, optionally an open box.

BACKGROUND

Containers made from cardboard, paperboard, or other card-based or paper-based materials or similar flexible sheet materials are provided for a variety of applications. Such containers, or boxes, may be used in a wide variety of applications, such as, but not limited to holding bottles for beverages. Such containers include a variety of features for a variety of purposes, which may be linked to aesthetic appeal, to structural considerations, or to manufacturing or cost-based considerations. Alternative considerations may also be relevant.

Some of these containers include a base layer of card-based or paper-based material, which would be considered as a substrate, or a backing, or a structural construction, and also a wrapping, or overwrap layer. The wrapping or overwrap layer may be used for covering the base layer material for aesthetic or tactile reasons, and/or to include printed designs for further aesthetic appeal and/or for conveying information, for example advertising, or nutritional information or other information.

In prior containers of this sort, the steps of erecting the container and of applying the overwrap material to the container have been performed in a simultaneous process.

There is a desire to improve the manufacturing process of wrapped containers, to speed up the process and/or to reduce the costs of manufacturing.

There is a further desire to reduce negative environmental impact from the full life cycle of such containers from their manufacturing, use and disposal combined.

This disclosure corresponds to the recognition that those desires can be met by separating the processes of wrapping and of erecting the container and the Applicant has recognised a particular means to enable such a separation of these processes.

Importantly, the finished container still maintains the necessary characteristics, with regard to structural integrity and aesthetic appeal, of a high-quality container for high-quality products.

SUMMARY

From a first aspect, there is provided a container made of a card-based or paper-based material such as cardboard or paperboard including: a first side wall panel; a second side wall panel adjacent the first side wall panel and connected to the first side wall panel along a first fold line; a third side wall panel adjacent to the second side wall panel and connected to the second side wall panel along a second fold line; a fourth side wall panel adjacent the third side wall panel and connected to the third side wall panel along a third fold line; a glue panel adjacent the fourth side wall panel and connected to the fourth side wall panel along a fourth fold line, wherein the glue panel is adhered to the first side wall panel, wherein a cross-section through the first, second, third and fourth side-wall panels provides a rectangle; a first base panel adjacent a proximal end of the first side wall panel and connected to the first side wall panel along a fifth fold line; a second base panel adjacent a proximal end of the second side wall panel and connected to the second side wall panel along a sixth fold line; a third base panel adjacent a proximal end of the third side wall panel and connected to the third side wall panel along a seventh fold line; a fourth base panel adjacent a proximal end of the fourth side wall panel and connected to the fourth side wall panel along an eighth fold line, wherein: each of the first and third base panels are substantially rectangular; the first and third base panel have a first width substantially equal to a second width of the first and third side wall panels; the second and fourth base panels have a third width less than a fourth width of the second and fourth side wall panels; the first width is measured parallel to the fifth and seventh fold lines; the second width is measured parallel to the fifth and seventh fold lines; the third width is measured parallel to the sixth and eighth fold lines; the fourth width is measured parallel to the sixth and eighth fold lines; each of the first and third base panels have a first length, measured perpendicular to each of the fifth and seventh fold lines respectively, substantially equal to half the fourth width; each of the second and fourth base panels have a second length, measured perpendicular to each of the sixth and eighth fold lines respectively, substantially equal to half the second width; and each of the first and third base panels are folded along each of the fifth and seventh fold lines respectively so as to lay on the inside of the second and fourth base panels; and a paper layer (also called an overwrap layer herein) covering and affixed to an entirety of an outside surface of all of the side wall panels, covering at least partially and affixed to an outside surface of each of the first and third base panels and covering and affixed to an entirety of an outside surface of each of the second and fourth base panels, wherein the paper layer includes: a first strip folded over an axial edge of the first side wall panel; and a second strip folded over distal edges of each of the first, second, third and fourth panels, wherein the paper layer includes a first pair of opposing overhanging portions extending laterally beyond a width of the second base panel on opposing sides of the second base panel and a second pair of opposing overhanging portions extending laterally beyond a width of the fourth base panel on opposing sides of the fourth base panel, wherein one of each of the first and second pair of overhanging portions is affixed to the first base panel and the other of each of the first and second pair of overhanging portions is affixed to the third base panel.

The overhanging portions allows the container to be erected in such a way that the base material does not show through or past the paper (overwrap) material at any point. This both provides for an improved visual appeal, but also improves some of the durability aspects of the container. For example, not having raw edges exposed means reduces the chance of moisture ingress into the panels of the container. The overhanging portions allow the container to be erected with use of a small amount of adhesive, rather than needing to apply adhesive to the entirety of the bottom panels. A container made in the form above can also be made separating the processes of wrapping (i.e., introducing the paper (overwrap) layer) and of erecting the container. This is beneficial in that the separated steps may be performed faster than both steps together, both because the steps can be performed at the same time on different containers and also because the less complicated process, by performing the steps separately allows the sum of the time to take each step to be smaller than the time to perform a combined process. Additionally, between the wrapping step and the erecting step, the blank may be transported as a flat blank, rather than needing to be transported as an erected container. This may allow the blank to be transported to a producer in the form of the flat blank for then erecting and packing products into the container, which will reduce energy costs, among other costs, as compared to transporting the bulkier, erected containers.

The paper (overwrap) layer may include a third strip folded over an axial edge of the glue panel, opposite the first strip.

The second strip may include a triplet of slits corresponding and adjacent to each of the first, second, third and fourth fold lines.

These slits are provided by cuts in the paper (overwrap) material, which may be parallel to one another and extending in the axial direction.

The slits allow for reduced reduced 'rucking' or unintended creasing of the strip when it is folded together with the panel. Rather the slits allow movement in the material. It has been found that a triplet of slits, i.e., three slits, is a preferred number to balance the number of slits which need to be made, and accordingly the lost integrity of the material, with the improvements as the material is folded.

Each fold line may include a pair of chamfered edges together forming a valley in the paper-based or card-based material.

These chamfered edges may extend a majority (e.g., about 75%) of the way through the base material and allow for easier folding of the panels.

The chamfered edges may be chamfered at about 45°, which allows for additional support for a fold of 90° with respect to each panel and so allows for a more accurate construction of the container. Of course, if a fold different from 90° is desired, at X°, then the chamfered edges may be chamfered at 0.5X° for the same effect.

Alternative means of providing the fold lines may be provided, such as embossed creases, or a score-line, or a perforated line. A perforated line would be acceptable aesthetically due to the presence of the paper (overwrap) layer.

One of the first, second, third and fourth side wall panels may include a first opening.

The first opening allows a consumer to view the product, e.g., drinks bottle, inside the container, and optionally, where the first opening is of sufficient size, to remove the product from the container. Where that is the case a fixed lid or top/distal panel arrangement may be used.

This also allows for the use of a reduced amount of material for the packaging, which may provide environmental benefits.

Another of the first, second, third and fourth side wall panels, opposite the one of the first, second, third and fourth side wall panels may include a second opening.

The second opening has similar benefits of the first opening.

It is also contemplated that additional openings may be included, either in the same panels as the first and second openings, or in the other side wall panels.

The first opening and the second opening may each occupy more than 50% of a surface area of the one and the other of the first, second, third and fourth side wall panels respectively.

The openings may occupy between 60% and 80% of the surface area of the respective side wall panel, optionally about 70%.

The side wall panels which have the openings may define a remaining portion, which may be around a border of the side wall panels, around the openings. The extent of the remaining portion may be about 0.5 cm to 2 cm, or about 1.0 to 1.5 cm, for example 1.2 cm.

The container may further include a lid configured to provide a closure to a distal end of the container.

The container may include another form of closure to the distal end.

The lid, where present may take any appropriate form, such as one or more closure flaps, or an insertable member, which may be shaped appropriately with features for securement to the remainder of the container. The lid may be replaceably removable from the container.

The lid may be formed from pulp, plastic, tin, or any other suitable material.

The paper (overwrap) layer may extend only partially over the first and third base panels in (underlaying) regions thereof, and the (underlaying) regions of the first and third base panels correspond to where the overhanging portions are affixed thereto.

This ensures that no more paper (overwrap) material is used than is required, and also provides an effective surface for bonding of the overhanging portions.

The container may be a container for a drinks bottle.

The container is made of appropriate materials to provide sufficient structural integrity and characteristics for supporting a drinks bottle.

Each of the second and fourth base panels may be substantially rectangular.

There is also provided a flat blank configured to be erected to provide the container of any of the above.

There is provided a flat blank configured to be erected to provide a container, wherein the flat blank includes: a first side wall panel; a second side wall panel adjacent the first side wall panel and connected to the first side wall panel along a first fold line; a third side wall panel adjacent to the second side wall panel and connected to the second side wall panel along a second fold line; a fourth side wall panel adjacent the third side wall panel and connected to the third side wall panel along a third fold line; a glue panel adjacent the fourth side wall panel and connected to the fourth side wall panel along a fourth fold line, wherein the glue panel is configured to be adhered to the first side wall panel, wherein the first, second, third and fourth side wall panels and the glue panel are arranged such that once the first, second, third and fourth fold lines are folded and the container erected a cross-section through the first, second, third and fourth side-wall panels provides a rectangle; a first base panel adjacent a proximal end of the first side wall panel and connected to the first side wall panel along a fifth fold line; a second base panel adjacent a proximal end of the second side wall panel and connected to the second side wall panel along a sixth fold line; a third base panel adjacent a proximal end of the third side wall panel and connected to the third side wall panel along a seventh fold line; a fourth base panel adjacent a proximal end of the fourth side wall panel and connected to the fourth side wall panel along an eighth fold line, wherein: each of the first, and third base panels are substantially rectangular; the first and third base panel have a first width substantially equal to a second width of the first and third side wall panels; the second and fourth base panels have a third width less than a fourth width of the second and fourth side wall panels; each of the first, second, third and fourth widths are measured parallel to each of the fifth, sixth, seventh and eighth fold lines respectively; each of the first and third base panels have a first length, measured perpendicular to each of the fifth and seventh fold lines respectively, substantially equal to half the fourth width; each of the second and fourth base panels have a second length, measured perpendicular to each of the sixth and eighth fold lines respectively, substantially equal to half the second width; and each of the first and third base panels are configured to be folded along each of the fifth and seventh fold lines respectively so as to lay on the inside of the second and fourth base panels in the erected container; and a paper layer covering and affixed to an entirety of a back surface of all of the side wall panels, covering at least partially and affixed to a back surface of each of the first and third base panels and covering and affixed to an entirety of a back surface of each of the second and fourth base panels, wherein the back surfaces of each of the side wall panels and of each of the base panels are configured to provide outside surfaces of each of the side wall panels and of the base panels once the container is erected, wherein the paper layer includes: a first strip folded over an axial edge of the first side wall panel; and a second strip folded over distal edges of each of the first, second, third and fourth panels, wherein the paper layer includes a first pair of opposing overhanging portions extending laterally beyond a width of the second base panel on opposing sides of the second base panel and second pair of opposing overhanging portions extending laterally beyond a width of the fourth base panel on opposing sides of the fourth base panel, wherein one of each of the first and second pair of opposing overhanging portions is configured to be affixed to the first base panel once the container is erected and the other of each of the first and second pair of opposing overhanging portions is configured to be affixed to the third base panel once the container is erected.

The blank may be transported as a flat blank, providing the environmental and other benefits mentioned above.

In some arrangements, it may be that only the first and second strips are affixed to the front surface of any of the panels. In this way, the first and second strips typically provide an 'L' shape. Alternatively, a third strip may also be included, wherein the third strip is affixed to the front surface of the panels, together with the first and second strips. In this way, the first, second and third strips typically provide a 'U' shape.

This provides for a simplified construction, reducing the wrapping time, and the amount of material required as compared to including a third and/or more strips. Two strips are still required to ensure adequate securing of the paper (overwrap) layer to the base material, and to ensure that raw edges are not exposed on the erected container.

There is also provided a method for constructing the container of any of the above, including: providing the flat blank of the above by providing the panels, affixing the paper layer to the outside surfaces thereof and folding over and affixing the first and second strips; folding up the first, second, third and fourth base panels and the glue panel and applying a strip of adhesive to a back surface of the glue panel to provide a cuboid tube; folding inwardly the first and third base panels; applying adhesive to the first and second pair of overhanging portions; and folding up the second and fourth base panels and exerting a force on the second and fourth base panels together with the overhanging portions by a compressible member such that the overhanging portions are pressed onto and thereby affixed to the parts of the first and third base panels which the overhanging portions overlap.

This method makes it possible to separate the steps of wrapping and erecting the container, providing the benefits as mentioned above.

The compressible member may be formed of a rubber material.

The compressible member may be formed of a foam material.

Between the steps of affixing the paper layer to the outside surfaces of the panels and of folding up the panels, the blank may be transported as a flat blank.

There is provided a method for forming a container, which the Applicant expressly reserves the right to claim independently, wherein the method includes: providing a base material blank with a plurality of panels and fold lines; wrapping a paper (overwrap) layer on the base material blank to fully cover any part of one side of the base material blank which will be an external surface on the erected container; leaving a plurality of overhanging portions of the paper (overwrap) layer overhanging some of the panels; erecting the container by folding up the plurality of panels about the fold lines using a compressible member to fold up panels overhung by the overhanging portions and thereby pressing the overhanging portions onto underlaying parts of other panels to adhere thereto.

There is provided a container made of a card-based or paper-based material such as cardboard or paperboard comprising: a first side wall panel; a second side wall panel adjacent the first side wall panel and connected to the first side wall panel along a first fold line; a third side wall panel adjacent to the second side wall panel and connected to the second side wall panel along a second fold line; a fourth side wall panel adjacent the third side wall panel and connected to the third side wall panel along a third fold line; a glue panel adjacent the fourth side wall panel and connected to the fourth side wall panel along a fourth fold line, wherein the glue panel is adhered to the first side wall panel, wherein a cross-section through the first, second, third and fourth side-wall panels provides a square; a first base flap adjacent a proximal end of the first base panel and connected to the first base panel along a fifth fold line; a second base flap adjacent a proximal end of the second base panel and connected to the second base panel along a sixth fold line; a third base flap adjacent a proximal end of the third base panel and connected to the third base panel along a seventh fold line; a fourth base flap adjacent a proximal end of the fourth base panel and connected to the fourth base panel along an eighth fold line, wherein: the first and third base panel have a first width substantially equal to a second width of the first and third side wall panels; the second and fourth base panels have a third width less than a fourth width of the second and fourth base panels; the first, second, third and fourth widths are measured parallel to the fifth, sixth, seventh and eighth fold lines; each of the first and third base panels have a first length, measured perpendicular to the fifth, sixth, seventh and eighth fold lines, substantially equal to half the fourth width; each of the second and fourth base panels have a second length, measured perpendicular to the fifth, sixth, seventh and eighth fold lines, substantially equal to half the second width; and each of the first and third base panels are folded underneath the second and fourth base panels; and an overwrap layer covering an entirety of a back surface of all of the side wall panels, covering at least partially a back surface of each of the first and third base panels and covering each an entirety of a back surface of the second and fourth base panels, wherein the overwrap layer includes: a first strip folded over an axial edge of the first side wall panel; and a second strip folded over distal edges of each of the first, second, third and fourth panels, wherein the overwrap layer includes a first pair of overhanging portions extending laterally beyond a width of the second base panel and second pair of overhanging portions extending laterally beyond a width of the fourth base panel, wherein each of the first and second pair of overhanging portions are affixed to the first or third base flaps.

The second strip may include a triplet of slits corresponding and adjacent to each of the first, second, third and fourth fold lines.

Each fold line may include a pair of chamfered edges together forming a valley in the paper-based or card-based material.

One of the first, second, third and fourth side wall panels may include a first opening.

Another of the first, second, third and fourth side wall panels, opposite the one of the first, second, third and fourth side wall panels may include a second opening.

The first opening and the second opening may each occupy more than 50% of a surface area of the one and the other of the first, second, third and fourth side wall panels respectively.

The container may further include a lid configured to provide a closure to a distal end of the container.

The overwrap layer may extend only partially over the first and third base panels in regions, and the overwrap layer may cover regions of the first and third base panels where the overhanging portions are affixed thereto.

The container may be a container for a drinks bottle.

There is also provided a flat blank configured to be erected to provide the container of any of the above, the flat blank including: the first, second, third and fourth side wall panels; the glue panel, not adhered to the first side wall panel; the first, second third and fourth base panels; and the overwrap layer, wherein the overwrap layer is affixed to the back surface of each of the panels and the first strip is affixed to the front surface of the first side wall panel, and the second strip is affixed to the front surface of each of the side wall panels.

In some arrangements, only the first and second strips are affixed to the front surface of any of the panels.

There is also provided a method for constructing the container of any of the above, comprising: providing the flat blank of any of the foregoing by providing the panels, affixing the overwrap layer to the back surfaces thereof and folding over and affixing the first and second strips; folding up the first, second, third and fourth base panels and the glue panel and applying a strip of adhesive to a back surface of the glue panel to provide a cuboid tube; folding inwardly the first and third base panels; applying adhesive to the first and second pair of overhanging portions; and folding up the second and fourth base panels and exerting a force on the second and fourth base panels together with the overhanging portions by a compressible member such that the overhanging portions are pressed onto and thereby affixed to the parts of the first and third base panels which the overhanging portions overlap.

The compressible member may be formed of a rubber material.

The compressible member may be formed of a foam material.

The method may include, between the steps of affixing the overwrap layer to the back surfaces of the panels and of folding up the panels, transporting the blank as a flat blank.

Any of the foregoing features may be combined in any arrangement, unless expressly indicated otherwise, or by nature mutually exclusive.

BRIEF DESCRIPTION OF DRAWINGS

Some preferred embodiments of the invention will now be described by way of example only, with reference to the accompanying drawings in which.

DETAILED DESCRIPTION

Figure 1:
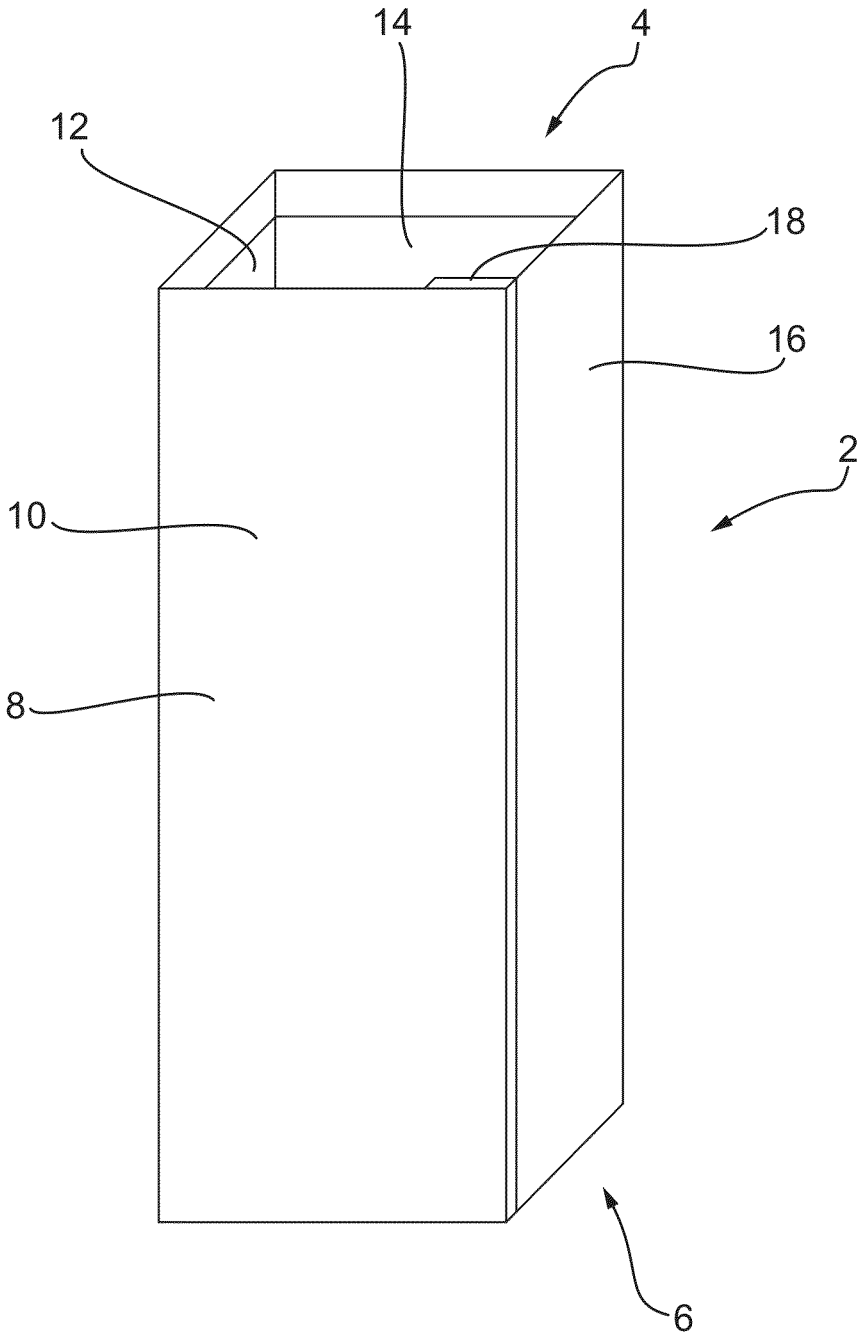
FIG. 1 is a schematic view of a container in accordance with an embodiment.

Illustrated in FIG. 1 is a container 2. The container 2 as shown is in the form of a cuboid box, with a square cross-section, and has a distal end 4 and a proximal end 6. The illustrated container 2 is orthogonal. The distal end 4 is open and the proximal end 6 is closed, although that is not visible in FIG. 1.

The container 2 is made of a card-based or paper-based material, such as card-board or paperboard. Other suitable flexible sheet materials may be used. Alternatively, rigid materials may be used to provide panels, with joins between panels of rigid materials to create the fold lines (described below) may be used. This material forms the base layer material, or the substrate material, and provides the main structural characteristics of the container 2

The container 2 includes an overwrap layer 8, which may be provided by a paper layer, optionally a gloss paper, a plasticised paper, a plastic-coated paper, uncoated paper, or metallised paper. Information, for example advertising, or information about the product inside, such as, but not limited to dietary information may be printed on the overwrap layer 8, as can artistic designs to improve the aesthetic appeal of the outside of the container 2.

The container 2 includes a first side wall panel 10, a second side wall panel 12 adjacent the first side wall panel 10, a third side wall panel 14 adjacent the second side wall panel 12 and a fourth side wall panel 16 adjacent the third side wall panel 14. The container 2 also includes a glue panel (or a glue flap) 18, which is shorter than the other panels 10, 12, 14, 16, and is adjacent the fourth side wall panel 16 and in a face-to-face relationship with and affixed to the firth side wall panel 10. The fixing of the glue panel 18 to the first side wall panel 10 is preferably by a strip of adhesive (not visible) between the two panels 18, 10.

The first and third side wall panels 10, 14 are opposite one another and may be referred to as a first opposing pair of side wall panels 10, 14 (or a first pair of opposite side wall panels 10, 14). Similarly, the second and fourth side wall panels 12, 16 are opposite one another and may be referred to as a second opposing pair of side wall panels 12, 16 (or a second pair of opposite side wall panels 12, 16). Each side wall panel 10, 12, 14, 16 is rectangular (in some embodiments they could be square) and has the same shape as each the other side wall panels 10, 12, 14, 16. The glue flap panel 18 has the same length as the lengths of the side wall panels 10, 12, 14, 16, but has a smaller width. The length is defined in the direction extending from the distal end 4 to the proximal end 6 of the container 2 (or vice versa), and the width is defined perpendicular to the length direction. As described below, the widths and lengths of the base panels (introduced below) are measured in corresponding directions when considered as part of the flat blank, rather than in the assembled form.

In some arrangements, not illustrated, the container 2 could have a rectangular cross section, wherein the first and third side wall panels 10, 14 have a width (a second width $W_2$, see below) different to a width (a fourth width $W_4$, see below) of the second and fourth side wall panels 12, 16.

Figure 2:
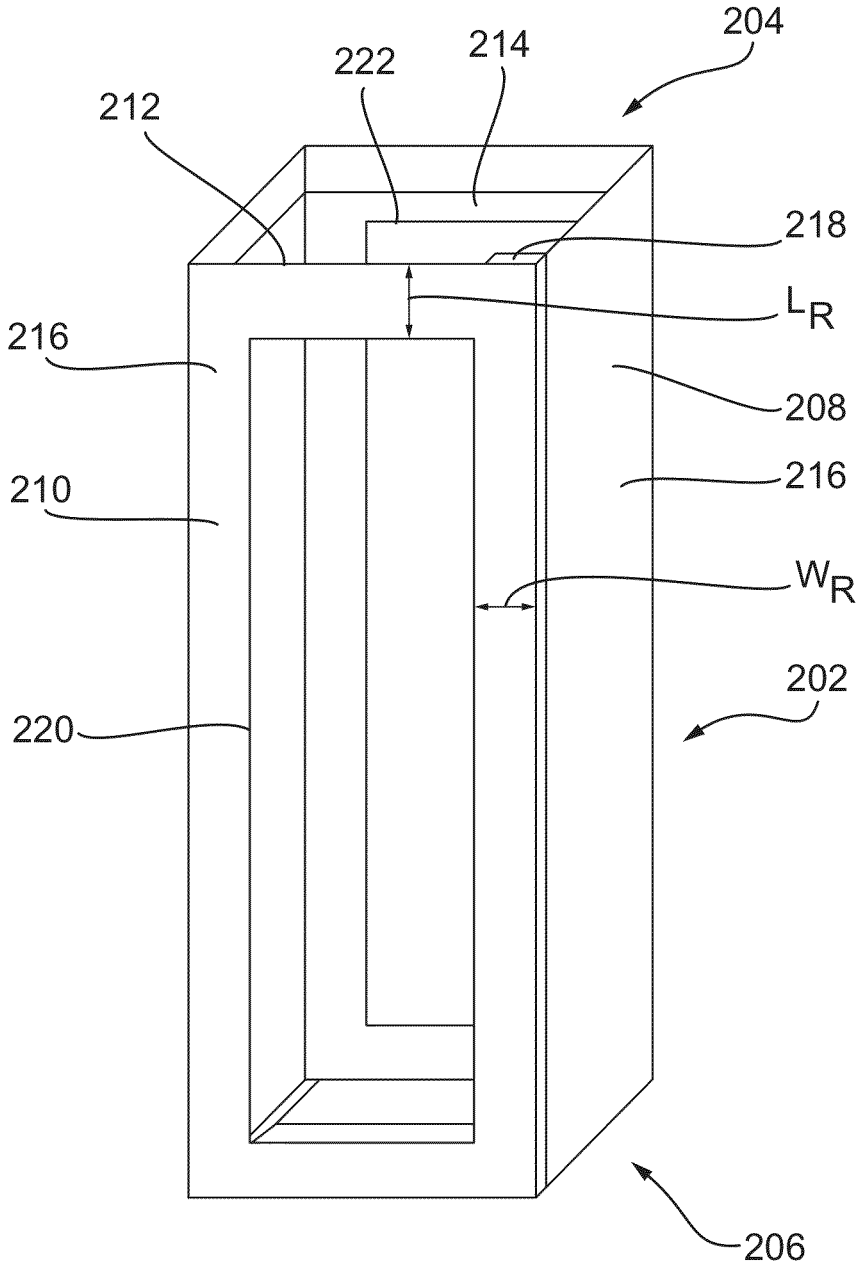
FIG. 2 is a schematic view of a container in accordance with another embodiment.

FIG. 2 illustrates another container 202. The container 202 of FIG. 2 corresponds to the container 2 of FIG. 1 and the features are described with the same reference numerals, but increased by 200. For example, the distal end of the container 202 of FIG. 2 is given the reference numeral 204, whereas the distal end of the container 2 of FIG. 1 is given the reference numeral 4. The container 202 of FIG. 2 differs from the container 2 of FIG. 1 in that the container 202 of FIG. 2 also includes a first opening 220 and a second opening 222 in the first side wall panel 210 and the third side wall panel 214 respectively. Of course, having these openings 220, 222 means that in some senses the first and third side wall panels 210, 214 have a different shape from the second and fourth side wall panels 212, 216; however, they may still have the same outline, and so could be considered to have the same shape. The openings 220, 222 as illustrated are rectangular openings and cover over 50% of the surface area of the first and third side wall panels 210, 214 respectively. In some arrangements, the openings 220, 222 may be of sufficient size for a user to be able to remove a bottle from the container 202 through one of the openings 220, 222. The remaining part 216 of the first and third side wall panels 210, 214 may have a remnant length $L_R$ and a remnant width $W_R$ respectively of between 0.5 cm and 2 cm, or more narrowly about 1 cm. Alternative shape and size openings 220, 222, and corresponding remaining parts 216 are also envisaged.

Although not illustrated, the containers 2, 202 could also include a lid, which may be provided by additional panels of flaps, joined by fold lines to distal edges of one or more of the side wall panels 10, 12, 14, 16, 210, 212, 214, 216, or by an insert which can slot into the distal end 4, 204 of the containers 2, 202. This may be made of pulp, plastic, tin or any other suitable material. Further features are envisaged that may be included which facilitate the use of such a lid.

Figure 3:
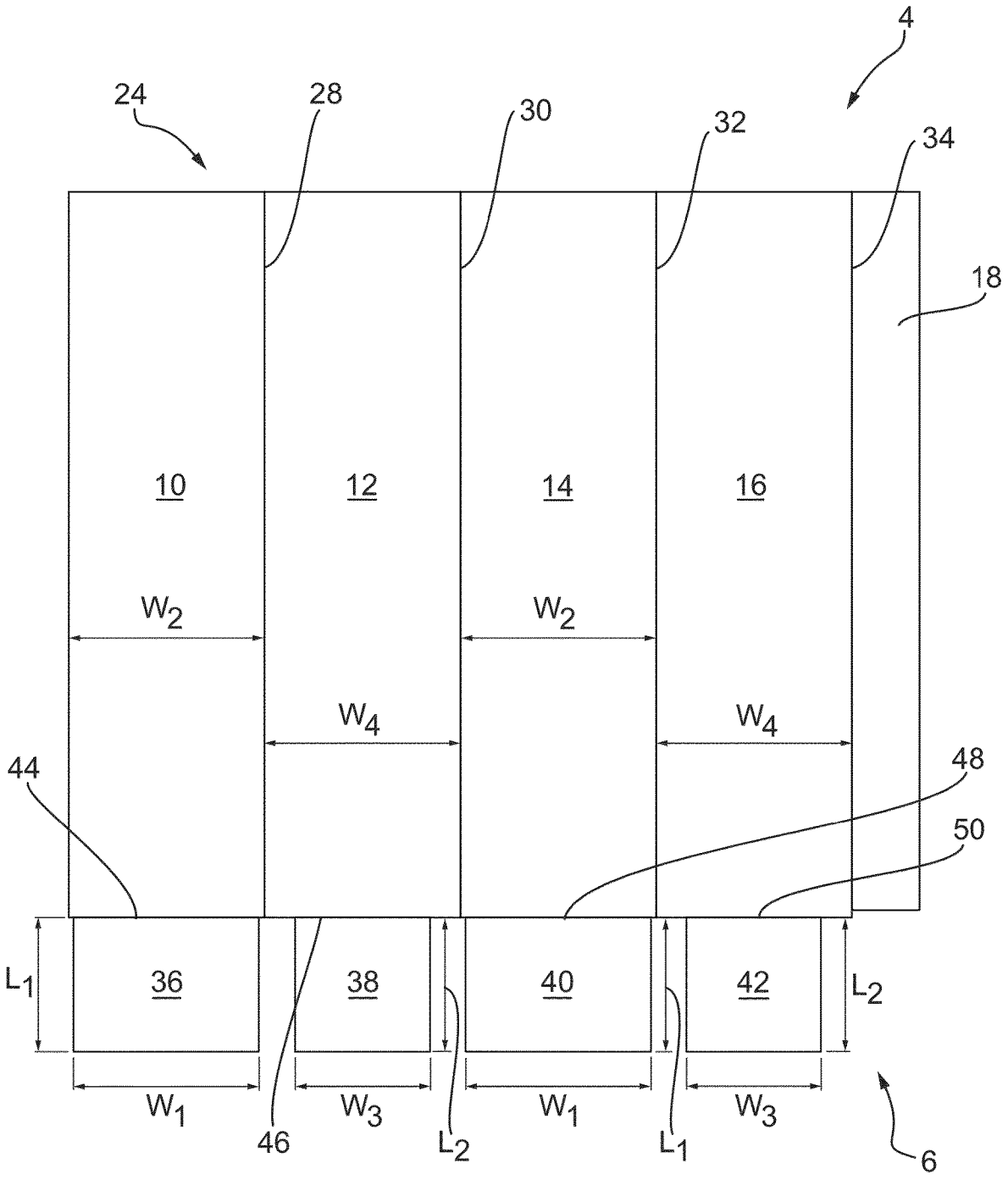
FIG. 3 is a schematic view of a part of a blank for the container of FIG. 1.
Figure 4:
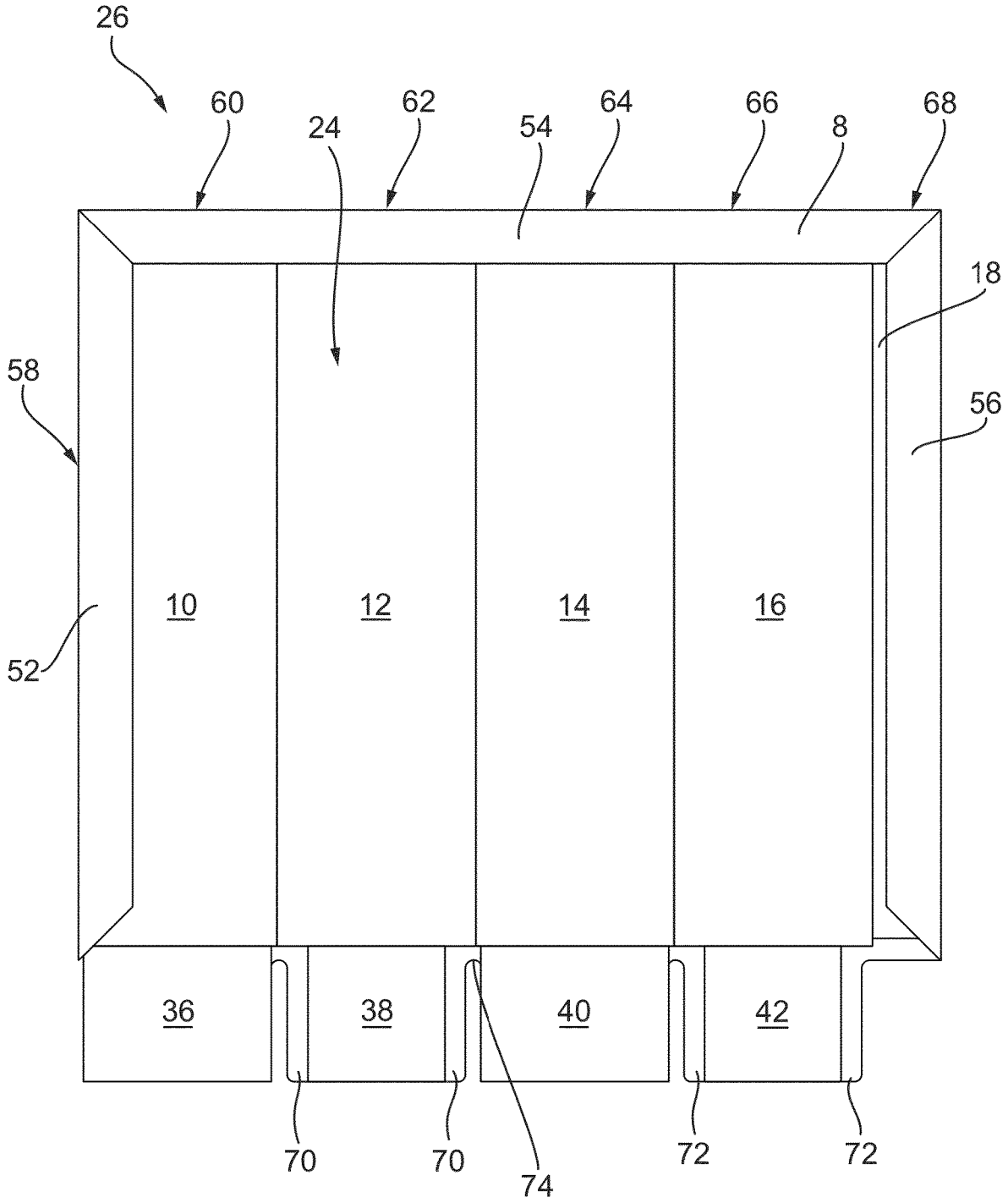
FIG. 4 is a front schematic view of a blank for the container of FIG. 1.
Figure 5:
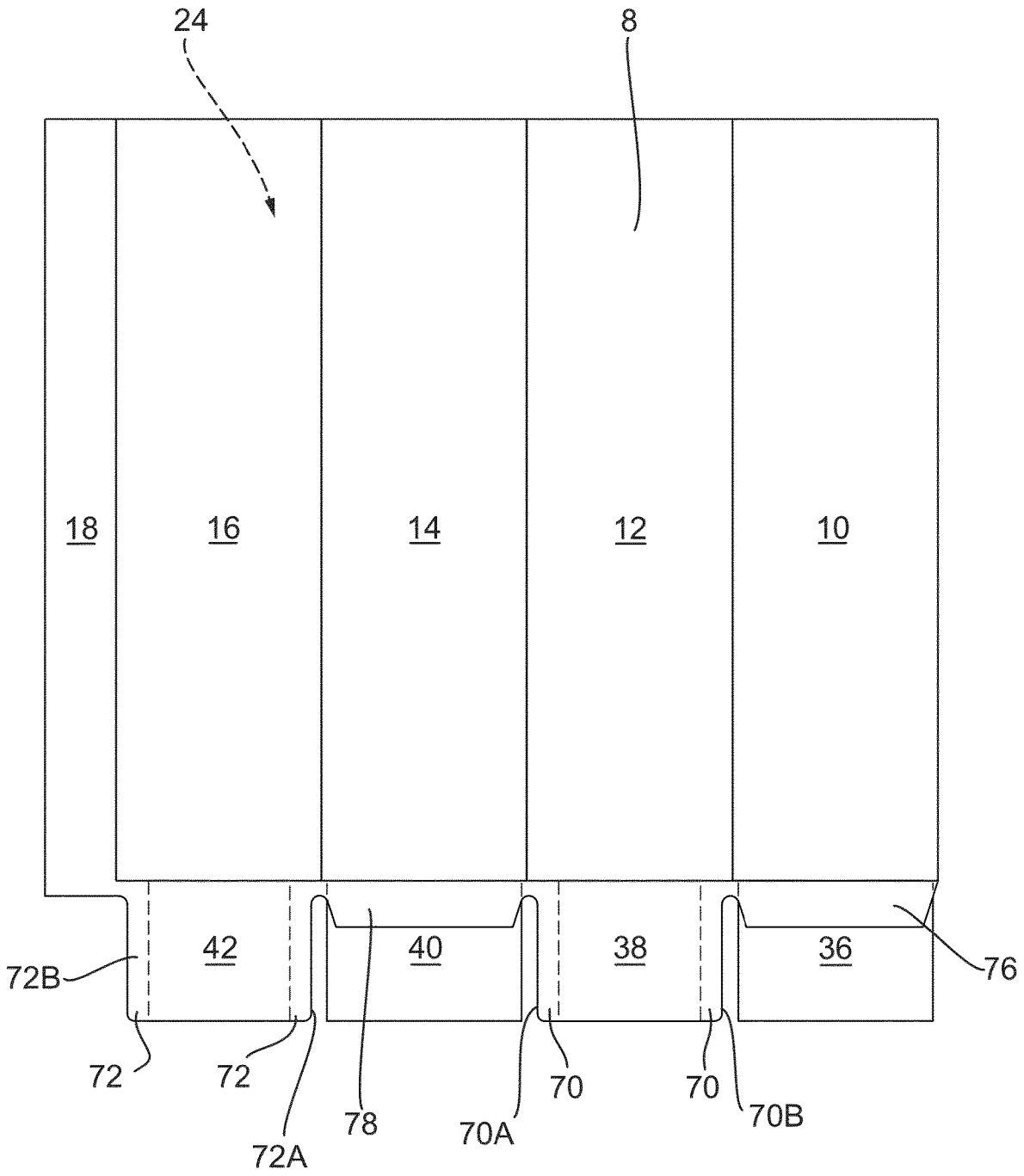
FIG. 5 is a rear schematic view of a blank for the container of FIG. 1.

Illustrated in FIGS. 3 to 5 is a blank 26 for the container 2 of FIG. 1. The blank may also be referred to as a net, or a template or similar. FIG. 3 shows just a part 24 of the blank 26, namely the substrate or base material 24, and FIGS. 4 and 5 show a front and back view of the blank 26 respectively. The front view of FIG. 4 shows the surfaces which are to form the interior surfaces of the erected container 2, and the back view (or rear view) of FIG. 5 shows the surfaces which are to form the exterior surfaces of the erected container 2. Each view also shows a selection of surfaces which are sandwiched between other panels and layers and so form neither internal nor exterior surfaces of the erected container 2.

FIGS. 4 and 5 include the blank 26 also including the overwrap layer 8.

As can be appreciated from FIG. 3, the first and second side wall panels 10, 12 are joined by a first fold line 28. The second and third side wall panels 12, 14 are joined by a second fold line 30. The third and fourth side wall panels 14, 16 are joined by a third fold line 32. The fourth side wall panel 16 and glue panel 18 are joined by a fourth fold line 34.

Each of the first to fourth fold lines 28, 30, 32, 34 extend in a longitudinal direction defined along the length of the container 2 from a distal end 4 to a proximal end 6 thereof. The form of the fold lines can take any appropriate form, but one particular example is presented below with reference to FIG. 6.

The container 2 and blank 26 also include a first base panel 36 (or base flap, or base flap panel) adjacent the first side wall panel 10 at a proximal side thereof. The container 2 and blank 26 also include a second base panel 38 (or base flap, or base flap panel) adjacent the second side wall panel 12 at a proximal side thereof. The container 2 and blank 26 also include a third base panel 40 (or base flap, or base flap panel) adjacent the third side wall panel 14 at a proximal side thereof. The container 2 and blank 26 also include a fourth base panel 42 (or base flap, or base flap panel) adjacent the fourth side wall panel 16 at a proximal side thereof.

The first base panel 36 is joined to the first side wall panel 10 by a fifth fold line 44. The second base panel 38 is joined to the second side wall panel 12 by a sixth fold line 46. The third base panel 40 is joined to the third side wall panel 14 by a seventh fold line 48. The fourth base panel 42 is joined to the fourth side wall panel 16 by an eighth fold line 50.

Each of the fifth to eighth fold lines 44, 46, 48, 50 extend in a direction perpendicular to the longitudinal direction (that is, perpendicular to each of the first to fourth fold lines 28, 30, 32, 34.

As illustrated, the first and third base panels 36, 40 have a first width $W_1$ and a first length $L_1$. The first and third side wall panels 10, 14 have a second width $W_2$. The second width $W_2$ may be substntially equal to the first width $W_1$, or may be slightly larger, for example, by about 1-2 mm, to allow for the width of material when folding. The second and fourth base panels 38, 42 have a third width $W_3$ and a second length $L_2$. The second and fourth side wall panels 12, 16 have a fourth width $W_4$. The fourth width $W_4$ is substantially larger than the third width $W_3$, in order to allow for overhanging portions of the overwrap layer 8 (described below). For example, the fourth width $W_4$ may be about 1 to 2 cm larger than the third width $W_3$, or more narrowly, about 1.5 cm larger than the third width $W_3$. The ratio of the third width $W_3$ to the fourth width $W_4$ may be about 0.8, or from about 0.5 to about 0.9.

The first length $L_1$ is substantially equal to half the fourth width $W_4$ in order that the first and third base panels 36, 40, when folded up extend across the entire width $W_4$ of the second and fourth side wall panels 12, 16. The second length $L_2$ is substantially equal to half the second width $W_2$ such that when the second and fourth base panels 38, 42 are folded up they extend across the entire width $W_2$ of the first and third side wall panels 10, 14.

In this manner, the first, second third and fourth base panels 36, 38, 40, 42, once folded up provide the base of the container 2 and overlap one another accordingly to provide a two-layered base.

When the cross section of the container 2 is to be square, the second and fourth widths $W_2$ and $W_4$ are equal to one another and the first and second lengths $L_1$ and $L_2$ are also equal to one another; however, with a rectangular cross-sectioned container, they are not equal.

As will be appreciated, these lengths and widths are not drawn to scale, but give a representative view to aid understanding.

FIG. 4 illustrates a blank 26 with the overwrap layer 8 applied. The majority of the overwrap layer 8 is not visible in FIG. 4 because it is behind the substrate or base material 24 in this view.

As can be appreciated from FIG. 4, the overwrap layer 8 includes a first strip 52, a second strip 54 and a third strip 56. Each of the first to third strips 52, 54, 56 have a generally trapezium shape and each strip 52, 54, 56 is folded around a respective edge of the base material 24 and affixed to the front surface of he base material 24 (which forms an internal surface of the erected container 2). The first strip 52 is folded round a first side edge 58 of the first side wall panel 10 and extends along the full length of the first side edge 58 of the first side wall panel 10. The second strip 54 is folded round and extends along a full length of a first distal edge 64 of the first side wall panel 10, a second distal edge 62 of the second side wall panel 12, a third distal edge 64 of the third side wall panel 14, a fourth distal edge 66 of the fourth side wall panel 16 and a fifth distal edge 68 of the glue panel 18.

As can be appreciated from FIGS. 4 and 5 in combination, the overwrap layer 8 includes, adjacent the second base panel 38, a first pair of overhanging portions 70, extending beyond the width $W_3$ of the second base panel 38, but not beyond the fourth width $W_4$ of the second side wall panel 12. The second and fourth base panels 38, 42 are shown in phantom in FIG. 5 by use of dashed lines.

The overwrap layer 8 also includes, adjacent the fourth base panel 42, a second pair of overhanging portions 72, extending beyond the width $W_3$ of the fourth base panel 42, but not beyond the fourth width $W_4$ of the fourth side wall panel 16.

The overhanging portions 70, 72 maybe joined to the remainder of the overwrap layer 8 at curved, or rounded joins 74, which may reduce the stress incurred when folding at these portions 74 and thus reduce the potential for tearing in the overwrap layer 8.

The overhanging portions 70, 72 extend along the full length $L_2$ of the second and fourth base panels 38, 42.

The overwrap layer 8 may include a first underlay portion 76 covering and affixed to a distal end of the first base panel 36 and a second underlay portion 78 covering and affixed to a distal end of the third base panel portion 40. These underlay portions 76, 78 may have a trapezium shape as illustrated. The first and second underlay portions 76, 78 are so called, because, in the erect container 2, they underlay the overhanging portions 70, 72, at least in part, and provide the surface to which the overhanging portions 70, 72 are adhered. Due to how the base panels 36, 38, 40, 42 are folded up (with the first and third panels 36, 40 being folded first, followed by the second and fourth panels 38, 42), one of the first pair of overhanging portions 70A and a mirroring one of the second pair of overhanging portions 72A are adhered to the second underlay portion 78 and the other of the first pair of overhanging portions 70B and the mirroring other of the second pair of overhanging portions 72B are adhered to the first underlay portion 76. Each overhanging portion 70, 72 is adhered half-way along a respective underlay portion 76, 78.

Figure 6:
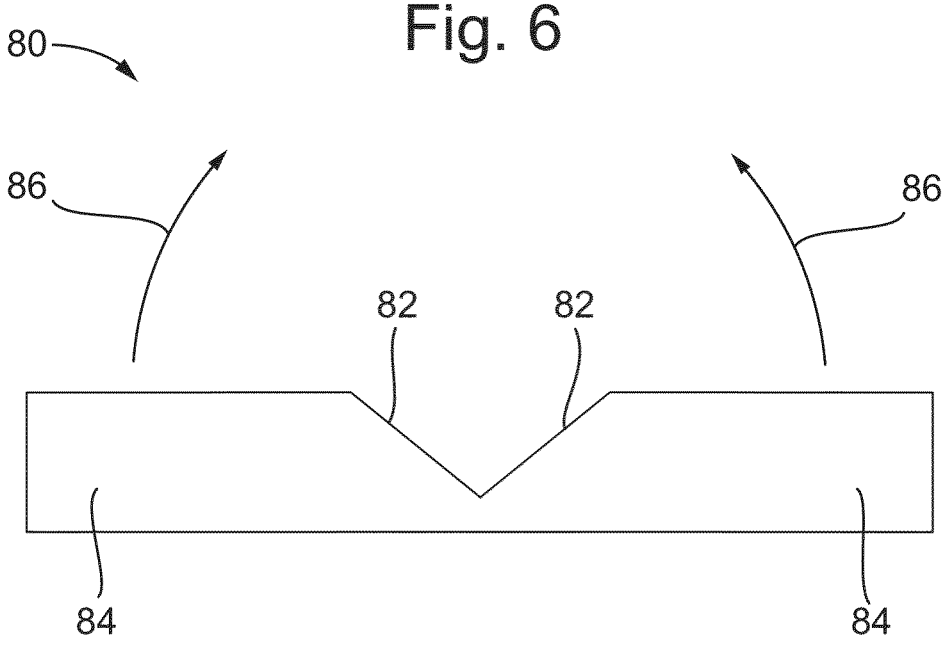
FIG. 6 is a cross-sectional schematic view of a fold line of the container before folding.

FIG. 6 illustrates a representative fold line 80 in accordance with certain embodiments.

The fold line 80 includes a pair of chamfered edges 82 about which panels 84 may fold about directions 86. These chamfered edges 82 maybe machined from a base material and thereby provide a valley which forms the fold line. The illustrated chamfered edges 82 are at about 45° to the surface of the panels 84, but it will be appreciated that other configurations are possible. It is envisaged that other such features may be used instead of chamfered edges 82, such as scores, or a pre-creased embossment. The choice of fold line 80 may depend on the material being used for the container 2.

Figure 7:
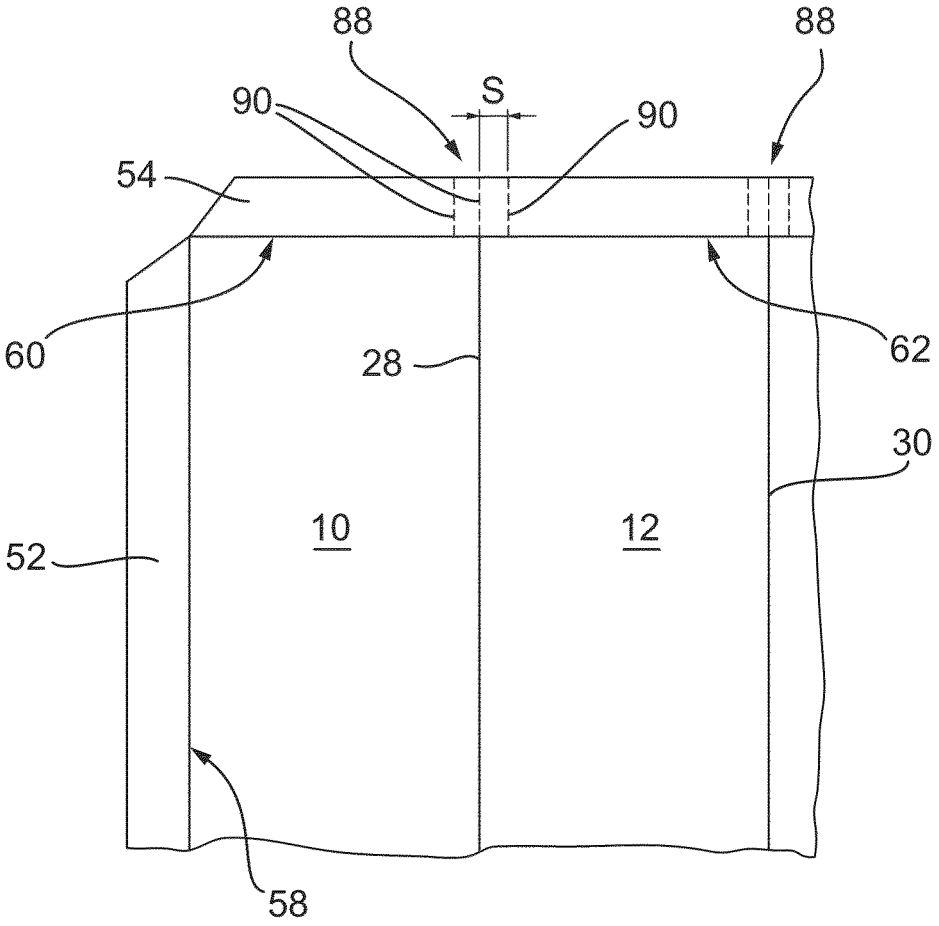
FIG. 7 is a schematic view illustrating a triple-slit feature in an overwrap layer.

Illustrated in FIG. 7 is a triplet of slits 88 including slits 90 made in the second strip 54. This triplet of slits 88 maybe included in the second strip 54 adjacent to respective fold lines that intersect the strip, such as the first and second fold lines 28, 30 as illustrated. These triplets of slits 88 provide relief for stresses and enable overlap in the second strip 54 when the panels, such as first and second side wall panels 10, 12 as illustrated, are folded along fold lines 28, 30. The triplets of slits 88 include slits 90 extending in a longitudinal direction, spaced apart at a spacing S. Spacing S may be approximately 1 mm to 5 mm. The strips 52, 54 shown in FIG. 7 have yet to be folded over the respective edges 58, 60, 62.

A slit may be defined as a cut in a material or a small amount of removal of material.

Figure 8:
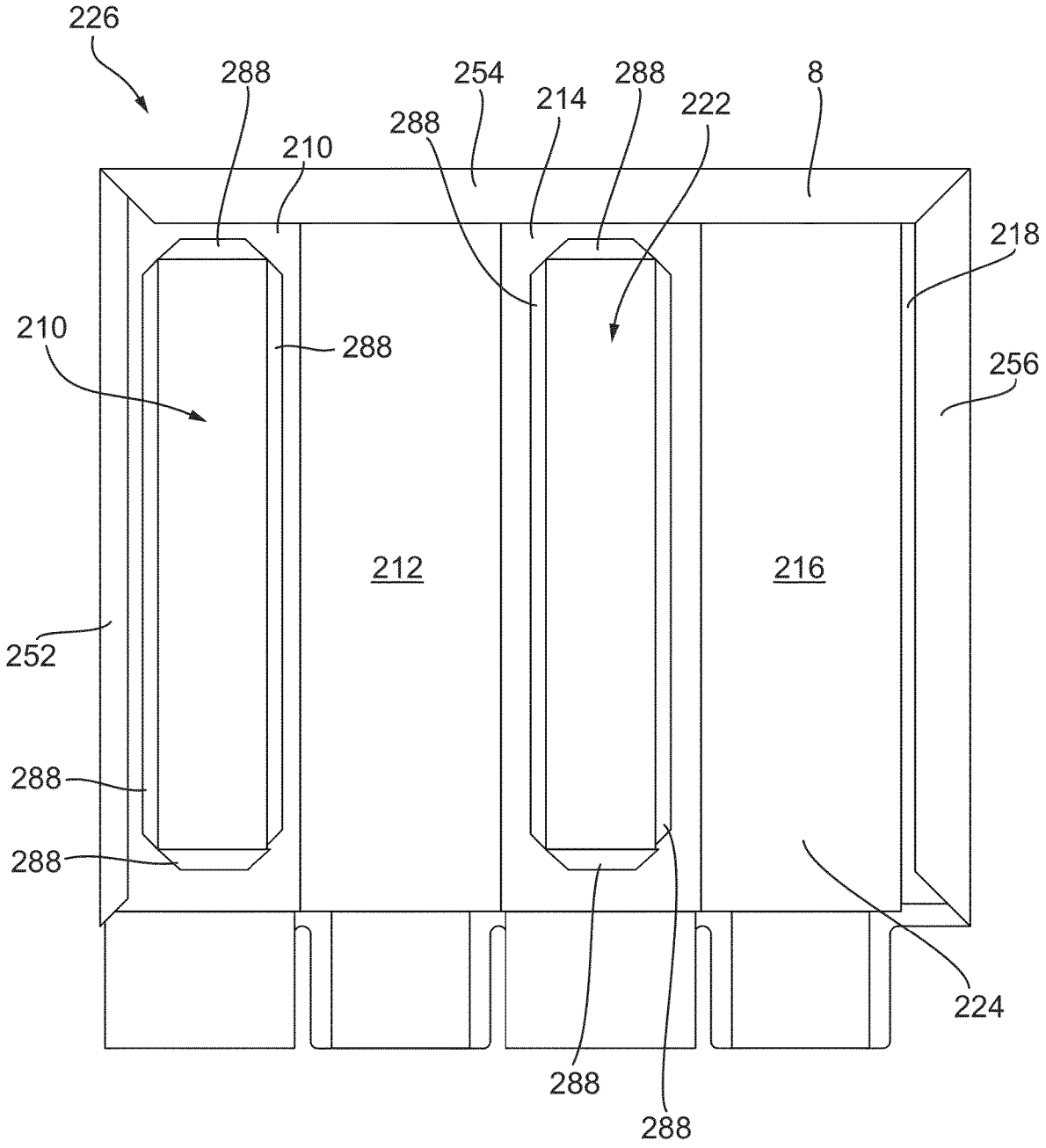
FIG. 8 is a schematic view of a blank for the container of FIG. 2.

FIG. 8 illustrates a blank 226 corresponding to the container 202 of FIG. 2. Only the features that differentiate the blank 226 of FIG. 8 from the blank 26 of FIGS. 3 to 5 are described below. The other features are the same.

Blank 226 includes openings 220 and 222 (or windows) in the first and third side wall panels 210, 214 respectively. It will be appreciated that the blank 226 of FIG. 8, and accordingly the container 202 of FIG. 2 could have fewer of more openings 220, 222. For example, there could be only the one opening 220, or the second and fourth side wall panels 212, 216 could also include openings. Alternatively, instead of a single opening 220, 222 in each of the first and third side wall panels 210, 214, one or both of the first and third side wall panels 210, 214 could include multiple openings.

Where openings 220, 222 are present, the size of the first, second and/or third strips 252, 254, 256 could be modified as appropriate to avoid extending into the opening 220, 222. As illustrated in FIG. 8, the first strip 252 is narrower than the first strip 52 shown in FIG. 4.

In a similar manner the size of the glue panel 218 may be made smaller so as to avoid overlapping the window 220 once the container 202 is erected.

Around each of the openings 220, 222 is a plurality of opening strips 288 of the overwrap layer 208. Each of the opening strips 288 are folded round edges of the openings 220, 222 and adhered to the front surface of the base material 224. As illustrated the opening strips 288 have a trapezium shape, but other shapes are possible.

The opening strips 288 are so called because they are strips which correspond to the openings 220, 222, rather than because they functionally have any opening effect or characteristics.

The size of the openings 220, 222 in the blank 226 of FIG. 8 of course corresponds to the size of the openings 220, 222 of FIG. 2.

Further features can be appreciated from FIG. 8. However, these features, where they have bene explained previously with reference to FIGS. 3 to 5 are not described again in detail or provided with reference numerals on the figure to improve the intelligibility of the features which are shown.

FIGS. 9A to 9F illustrate, sequentially, the steps of erecting the container 2 of FIG. 1.

For illustration purposes, only a selection of the reference numerals have been included in FIGS. 9A to 9F.

As will be appreciated, the blank 26 and assembly in FIGS. 9A to 9F is in fact a mirror of the blank 26 illustrated in FIGS. 3 to 5; however, the principles of construction are the same, and the reference numerals are accordingly the same.

Figure 9A:
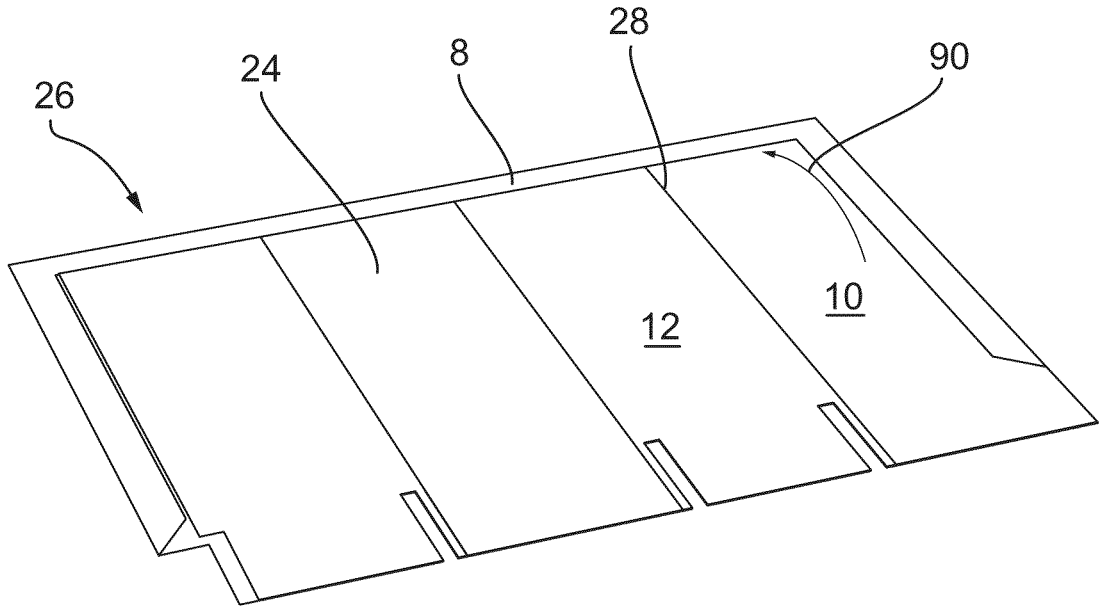
FIGS. 9A to 9F illustrate some stages of manufacture of the container of FIG. 1.

Shown in FIG. 9A is a perspective view of the blank 26 as shown in FIG. 4. The blank 26 already has the overwrap layer 8 applied thereto at a back surface of the base material 24, and with the first, second and third strips 52, 54, 56 folded over and bonded round the relevant edges of the base material 24.

Figure 9B:
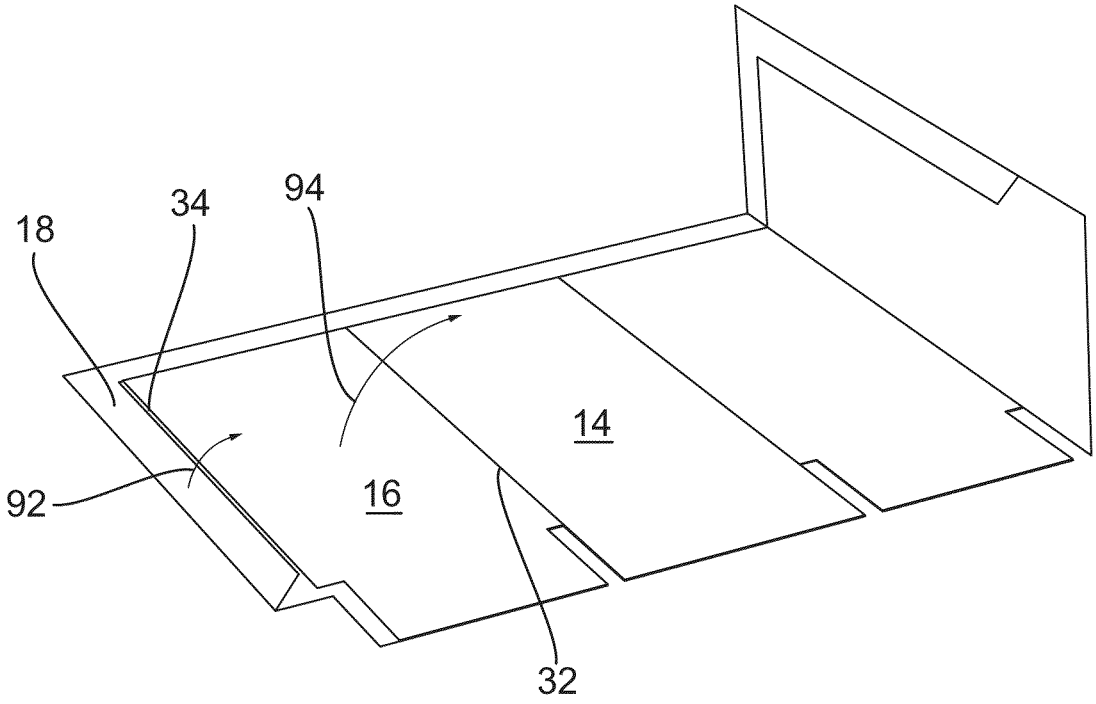

Shown at the arrow 90 in FIG. 9A is a folding step, wherein the first side wall panel 10 is folded up relative to the second side-wall panel 12, about first fold line 28 to provide an angle of about 90° as can be appreciated in FIG. 9B.

FIG. 9B shows at arrow 92 the step of folding the glue panel 18 relative to the fourth side wall panel 16 about fourth fold line 34. FIG. 9B also shows at arrow 94 the step of folding the fourth side wall panel 16 (together with the glue panel 18) relative to the third side wall panel 14 about the third fold line 32. Each of these folds provide an angle of about 90° as can be appreciated in FIG. 9C.

Figure 9C:
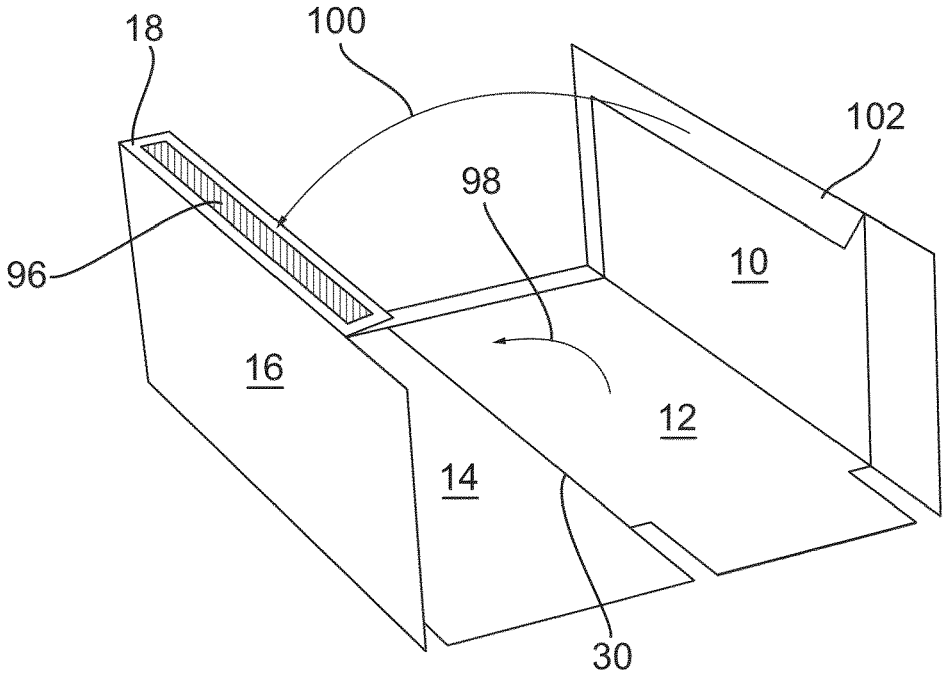
Figure 9D:
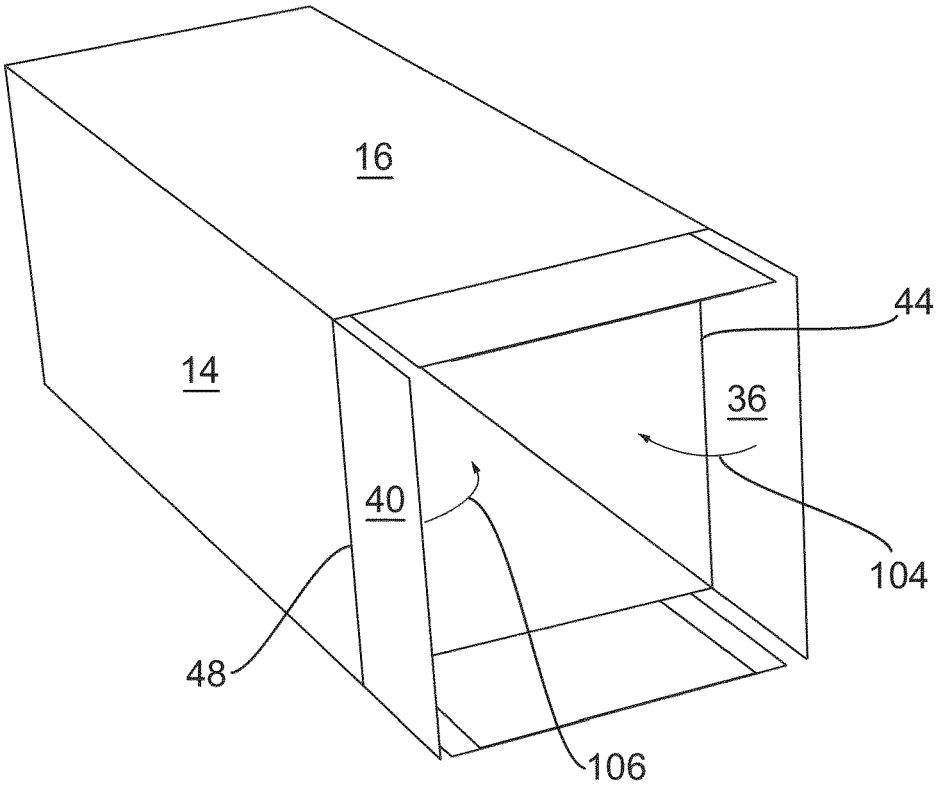

FIG. 9C shows a line of adhesive 96 applied to the glue panel 18, on a back surface thereof and also shows, at arrows 98, 100, the step of folding the second side wall panel 12 (together with the first side wall panel 10) relative to the third side wall panel 14 about the second fold line 30, such that a portion 102 of (a front surface of) the first side wall panel 10 is brought into face-to face contact with and is thus bonded to (the back surface of) the glue panel 18 where the line of adhesive 96 has been applied. The fold provides an angle of about 90°, and provides a square tube as can be appreciated at FIG. 9D. FIG. 9D is rotated clockwise a quarte turn relative to the image in FIG. 9C.

In FIG. 9D, there is shown at arrow 104 the step of folding inwardly the first base panel 36 about fifth fold line 44 as well as, at arrow 106, the step of folding inwardly the third base panel 40 about seventh fold line 48. These folds provide an angle of about 90° as can be appreciated from FIG. 9E.

Figure 9E:
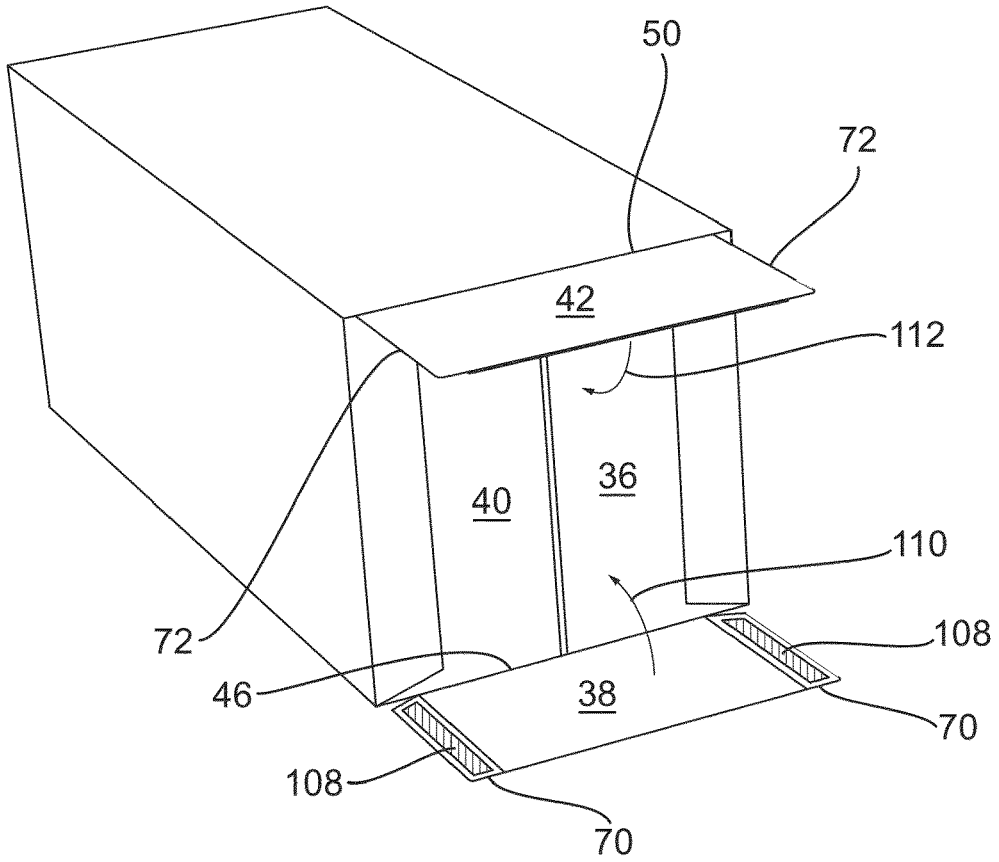
Figure 9F:
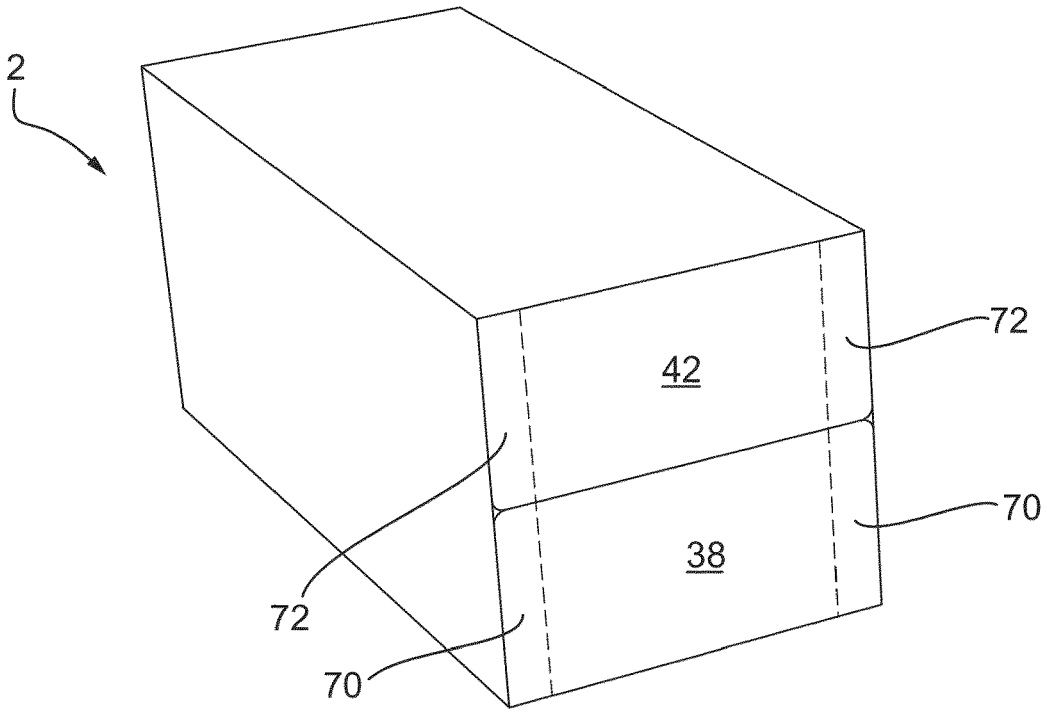

FIG. 9E shown the application of base panel adhesive 108 to each of the overhanging portions 70, 72 associated with each of the second base panel 38 and fourth base panel 42. As will be appreciated, the base panel adhesive on the overhanging portion 72 associated with the fourth base panel 42 are not visible in the figure but are present. FIG. 9E also illustrates the step of folding in the second base panel 38 at arrow 110 about sixth fold line 46 about 90° and the step of folding in the fourth base panel 42 at arrow 112 about eighth fold line 50 about 90°. These folding steps bring the second base panel 38 and the fourth base panel 42 into face-to-face contact with the first and third base panels 36, 40 to provide the container as shown in FIG. 9F.

Figure 10:
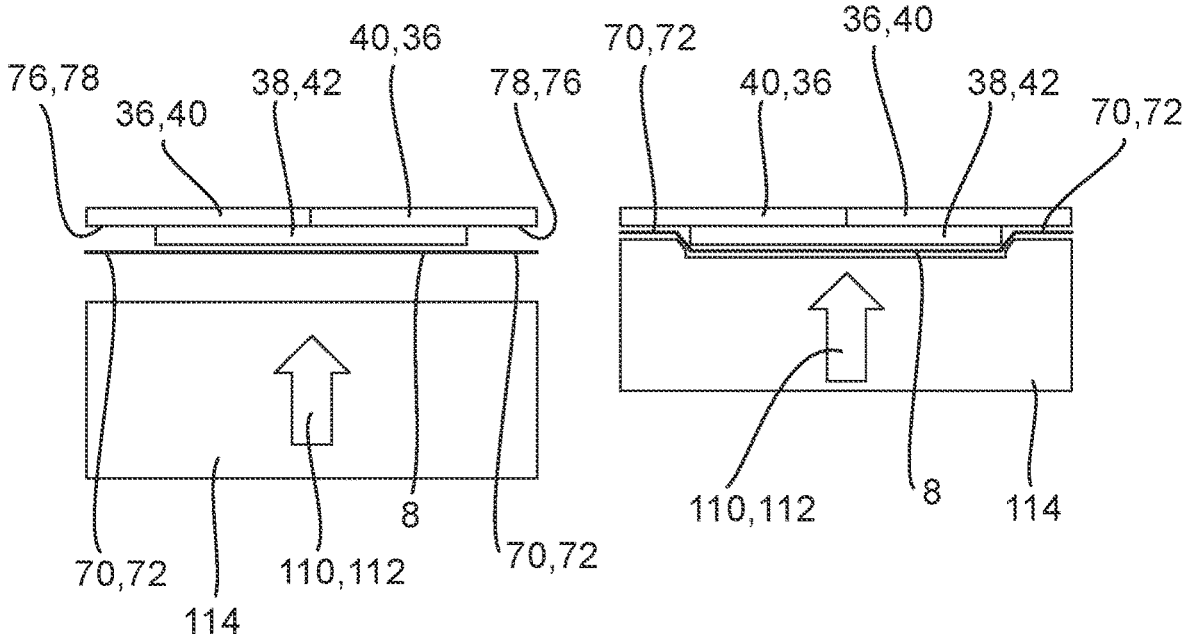
FIG. 10 is a schematic cross-sectional view of one of the manufacturing steps for making the container.

Of particular note, and with reference to FIG. 10 this folding step of FIG. 9E is performed by exerting a force onto each of the second and fourth base panels 38, 42 with a compressible member 114 (such as one made of rubber material, or foam material). The use of the compressible member 114 ensures that a force is exerted onto the overhanging portions 70, 72 even when the compressible member 114 has contacted the central portions of the overwrap layer 8, the second or fourth base panel 38, 42 and the relevant parts of the first and third base panels 36, 40. Thus the overhanging portions are pushes onto the first and second underlay portions 76, 78 of the first and third base panels 36, 40 and can be bonded thereto.

In contrast, if the compressible member 114 were replaced with a rigid member, the overhanging portions 70, 72 would be left hanging, or alternatively, the third width $W_3$ of the second and fourth base panels 38, 42 would need be made the same as the fourth width of the second and fourth side wall panels 12, 16, but this would result in raw edges being visible at the side of the second and fourth base panels 38, 42 in the final container 2, 202.

As a result, the process of the present disclosure, using the blank 26, 226 described herein, and the method steps of FIGS. 9A to 9F, in particular including the compressible member 114, makes possible to separate the wrapping and erecting processes while still providing a satisfactorily neat final container 2, 202.

As will be appreciated, various changes and modifications can be made to the presently described arrangement, provided that the overwrap layer 8 includes some overhanging portions 70, 72 which can be fixed or bonded during the erection process of the container 2, 202. For example, it is envisaged that the container 2, 202 need not be limited to having a square cross-section.

The term fold line used herein is defined as a line about which panels may be folded. The fold line may include particular features to improve the folding process, such as those shown in FIG. 6, but need not include those particular features to be a fold line, provided the fold lines are easier to fold than the surrounding material.

The term proximal is defined as being toward the base of the container, which is considered as a base, being at the bottom of the container in typical use. The term distal is used to refer to the opposite of proximal. An axial direction, or longitudinal direction is defined as extending from a proximal end to a distal end or vice versa.

The container 2 maybe of a typical size to hold a 750 ml drinks bottle, or alternatively may hold larger or smaller drinks bottles (such as 375 ml or 1.5 l), or be used for packaging other products. More particularly, the container may be about 5 to 15 cm wide, e.g., about 7 to 12 cm wide, or about 8 cm wide and the container may be about 20 to 40 cm tall, e.g., 25 to 35 cm tall, or about 30 cm tall.

The material chosen for the container (both for the substrate or base material, and for the overwrap layer) may be selected depending on the use for which the container is intended. For example, to contain heavier products, the container will have more robust materials and may only need weaker materials for lighter products.

The invention claimed is:

1. A container made of a card-based or paper-based material such as cardboard or paperboard comprising: a first side wall panel; a second side wall panel adjacent the first side wall panel and connected to the first side wall panel along a first fold line; a third side wall panel adjacent to the second side wall panel and connected to the second side wall panel along a second fold line; a fourth side wall panel adjacent the third side wall panel and connected to the third side wall panel along a third fold line; a glue panel adjacent the fourth side wall panel and connected to the fourth side wall panel along a fourth fold line, wherein the glue panel is adhered to the first side wall panel, wherein a cross-section through the first, second, third and fourth side-wall panels provides a rectangle; a first base panel adjacent a proximal end of the first side wall panel and connected to the first side wall panel along a fifth fold line; a second base panel adjacent a proximal end of the second side wall panel and connected to the second side wall panel along a sixth fold line; a third base panel adjacent a proximal end of the third side wall panel and connected to the third side wall panel along a seventh fold line; a fourth base panel adjacent a proximal end of the fourth side wall panel and connected to the fourth side wall panel along an eighth fold line, wherein: each of the first, and third base panels are substantially rectangular; the first and third base panels have a first width substantially equal to a second width of the first and third side wall panels; the second and fourth base panels have a third width less than a fourth width of the second and fourth side wall panels; the first width is measured parallel to the fifth and seventh fold lines; the second width is measured parallel to the fifth and seventh fold lines; the third width is measured parallel to the sixth and eighth fold lines; the fourth width is measured parallel to the sixth and eighth fold lines; each of the first and third base panels have a first length, measured perpendicular to each of the fifth and seventh fold lines respectively, substantially equal to half the fourth width; each of the second and fourth base panels have a second length, measured perpendicular to each of the sixth and eighth fold lines respectively, substantially equal to half the second width; and each of the first and third base panels are folded along each of the fifth and seventh fold lines respectively so as to lay on the inside of the second and fourth base panels; and a paper layer covering and affixed to an entirety of an outside surface of all of the side wall panels, covering at least partially and affixed to an outside surface of each of the first and third base panels and covering and affixed to an entirety of an outside surface of each of the second and fourth base panels, wherein the paper layer includes: a first strip folded over an axial edge of the first side wall panel; and a second strip folded over distal edges of each of the first, second, third and fourth side wall panels, wherein the paper layer includes a first pair of opposing overhanging portions extending laterally beyond a width of the second base panel on opposing sides of the second base panel and a second pair of opposing overhanging portions extending laterally beyond a width of the fourth base panel on opposing sides of the fourth base panel, wherein one of each of the first and second pair of overhanging portions is affixed to the first base panel and the other of each of the first and second pair of overhanging portions is affixed to the third base panel.

2. The container of claim 1, wherein the second strip includes a triplet of slits corresponding and adjacent to each of the first, second, third and fourth fold lines.

3. The container of claim 1, wherein each fold line includes a pair of chamfered edges together forming a valley in the paper-based or card-based material.

4. The container of claim 1, wherein one of the first, second, third and fourth side wall panels includes a first opening.

5. The container of claim 4, wherein another of the first, second, third and fourth side wall panels, opposite the one of the first, second, third and fourth side wall panels includes a second opening.

6. The container of claim 5, wherein the first opening and the second opening each occupy more than 50% of a surface area of the one and the other of the first, second, third and fourth side wall panels respectively.

7. The container of claim 1, further comprising a lid configured to provide a closure to a distal end of the container.

8. The container of claim 1, wherein the paper layer extends only partially over the first and third base panels in regions, and wherein the regions of the first and third base panels correspond to where the overhanging portions are affixed thereto.

9. The container of claim 1, wherein each of the second and fourth base panels are substantially rectangular.

10. A flat blank for a container, wherein the flat blank includes: a first side wall panel; a second side wall panel adjacent the first side wall panel and connected to the first side wall panel along a first fold line; a third side wall panel adjacent to the second side wall panel and connected to the second side wall panel along a second fold line; a fourth side wall panel adjacent the third side wall panel and connected to the third side wall panel along a third fold line; a glue panel adjacent the fourth side wall panel and connected to the fourth side wall panel along a fourth fold line; a first base panel adjacent a proximal end of the first side wall panel and connected to the first side wall panel along a fifth fold line; a second base panel adjacent a proximal end of the second side wall panel and connected to the second side wall panel along a sixth fold line; a third base panel adjacent a proximal end of the third side wall panel and connected to the third side wall panel along a seventh fold line; a fourth base panel adjacent a proximal end of the fourth side wall panel and connected to the fourth side wall panel along an eighth fold line, wherein: each of the first and third base panels are substantially rectangular; the first and third base panels have a first width substantially equal to a second width of the first and third side wall panels; the second and fourth base panels have a third width less than a fourth width of the second and fourth side wall panels; the first width is measured parallel to the fifth and seventh fold lines; the second width is measured parallel to the fifth and seventh fold lines; the third width is measured parallel to the sixth and eighth fold lines; the fourth width is measured parallel to the sixth and eighth fold lines; each of the first and third base panels have a first length, measured perpendicular to each of the fifth and seventh fold lines respectively, substantially equal to half the fourth width; and each of the second and fourth base panels have a second length, measured perpendicular to each of the sixth and eighth fold lines respectively, substantially equal to half the second width; and a paper layer covering and affixed to an entirety of a back surface of all of the side wall panels, covering at least partially and affixed to a back surface of each of the first and third base panels and covering and affixed to an entirety of a back surface of each of the second and fourth base panels, wherein the paper layer includes: a first strip folded over an axial edge of the first side wall panel; and a second strip folded over distal edges of each of the first, second, third and fourth side wall panels, wherein the paper layer includes a first pair of opposing overhanging portions extending laterally beyond a width of the second base panel on opposing sides of the second base panel and second pair of opposing overhanging portions extending laterally beyond a width of the fourth base panel on opposing sides of the fourth base panel.

11. The flat blank of claim 10, wherein only the first and second strips are affixed to the front surface of any of the panels.

12. A method for constructing the container of claim 1, comprising: providing the flat blank of claim 10 by providing the panels, affixing the paper layer to the outside surfaces thereof and folding over and affixing the first and second strips; folding up the first, second, third and fourth side wall panels and the glue panel and applying a strip of adhesive to an outside surface of the glue panel to provide a cuboid tube; folding inwardly the first and third base panels; applying adhesive to the first and second pair of overhanging portions; and folding up the second and fourth base panels and exerting a force on the second and fourth base panels together with the overhanging portions by a compressible member such that the overhanging portions are pressed onto and thereby affixed to the parts of the first and third base panels which the overhanging portions overlap.

13. The method of claim 12, wherein the compressible member is formed of a rubber material.

14. The method of claim 12, wherein the compressible member is formed of a foam material.

15. The method of claim 12, wherein, between the steps of affixing the paper layer to the outside surfaces of the panels and of folding up the panels, transporting the blank as a flat blank.

* * * * *